US010596723B2

(12) United States Patent
Chiang

(10) Patent No.: US 10,596,723 B2
(45) Date of Patent: Mar. 24, 2020

(54) CUTTING TOOL HOLDING DEVICE

(71) Applicant: EVERPADS CO., LTD., Taichung (TW)

(72) Inventor: Chun-Li Chiang, Taichung (TW)

(73) Assignee: EVERPADS CO., LTD., Taichung (TW)

( * ) Notice: Subject to any disclaimer, the term of this patent is extended or adjusted under 35 U.S.C. 154(b) by 0 days.

(21) Appl. No.: 16/044,497

(22) Filed: Jul. 24, 2018

(65) Prior Publication Data

US 2019/0030755 A1 Jan. 31, 2019

(30) Foreign Application Priority Data

Jul. 27, 2017 (TW) ..... 106211075 U

(51) Int. Cl.

| | |
|---|---|
| ***E21C 35/193*** | (2006.01) |
| ***E01C 23/088*** | (2006.01) |
| ***B28D 1/18*** | (2006.01) |
| *E21C 35/19* | (2006.01) |

(52) U.S. Cl.

CPC ..... *B28D 1/186* (2013.01); *B28D 1/188* (2013.01); *E01C 23/088* (2013.01); *E21C 35/193* (2013.01); *E21C 35/1933* (2013.01); *E21C 2035/191* (2013.01)

(58) Field of Classification Search

CPC .. E21C 35/19; E21C 2035/191; E21C 35/193; E21C 35/1933; E21C 35/1936; E21C 35/197; B28D 1/186; B28D 1/188; E01C 23/088; E01C 23/127

See application file for complete search history.

(56) References Cited

U.S. PATENT DOCUMENTS 3,796,464 A * 3/1974 Hansen ..... E21C 35/1933 299/104
4,057,294 A * 11/1977 Krekeler ..... E02F 9/2816 299/102
4,261,620 A * 4/1981 Troxler ..... E21B 10/58 299/113
4,271,735 A * 6/1981 Denman ..... E21C 35/19 407/109
4,609,227 A * 9/1986 Wild ..... E21C 35/18 299/103

(Continued)

FOREIGN PATENT DOCUMENTS

DE 4015022 A1 * 11/1990 ..... E21C 35/187
GB 2223045 A * 3/1990 ..... E21C 35/193

*Primary Examiner* — Janine M Kreck
*Assistant Examiner* — Michael A Goodwin
(74) *Attorney, Agent, or Firm* — CKC & Partners Co., LLC

(57) ABSTRACT

A cutting tool holding device, which is for holding a cutting tool, includes a base, a holder, and a limiting set, wherein the holder is disposed on the base, and the limiting set is disposed in a non-circular channel of the base. A connecting shaft portion of the holder is for inserting into a storage hole of the base, wherein the connecting shaft portion includes a shaft body and at least one positioning portion, and the non-circular channel includes an abutting member and a bolt. The bolt is passed through the abutting member, wherein the abutting member is moved to an opening hole of the storage hole along an axis by rotating the bolt so as to push the positioning portion and abut the shaft body.

6 Claims, 7 Drawing Sheets

(56) References Cited

U.S. PATENT DOCUMENTS

| | | | | |
|---|---|---|---|---|
| 6,523,768 | B2 * | 2/2003 | Recker | B02C 18/145 241/294 |
| 2005/0150666 | A1 * | 7/2005 | Holl | E21C 35/193 172/1 |
| 2006/0243840 | A1 * | 11/2006 | Latham | E21C 35/1936 241/294 |
| 2009/0174252 | A1 * | 7/2009 | Morris | E21C 35/1933 299/111 |
| 2013/0307316 | A1 * | 11/2013 | Roetsch | B28D 1/188 299/39.4 |
| 2014/0117741 | A1 * | 5/2014 | Lehnert | E21C 35/193 299/81.1 |
| 2019/0039154 | A1 * | 2/2019 | Miao | B23C 5/26 |

* cited by examiner

100

CUTTING TOOL HOLDING DEVICE

RELATED APPLICATIONS

This application claims priority to Taiwan Application Serial Number 106211075, filed Jul. 27, 2017, which is herein incorporated by reference.

BACKGROUND

Technical Field

The present disclosure relates to a cutting tool holding device. More particularly, the present disclosure relates to a cutting tool holding device for a road planer.

Description of Related Art

Milling drums of road planers are equipped with a plurality of cutting tools generally, and the cutting tools are arranged in spiral-shaped. When road planers are running, the cutting tools can mill by rotating milling drums, and the cutting tools are disposed on milling drums by cutting tool holding devices.

The conventional cutting tool holding device includes a base and a holder, the holder is disposed on the base and for the cutting tool to connect, wherein the holder is engaged with the base by a removable fastening member so as to repair or replace the cutting tool.

In use, the cutting tool for milling road would apply a high pressure on the road and may cause damage easily due to the reaction force. When the structure configuration of the cutting tool holding device is improper, more serious damages would cause by the reaction force easily due to infirm engagement between the holder and the base. As a result, service life of the cutting tools and the cutting tool holding device would be reduced cost of replacement and repair would be increased. Moreover, since the base and the holder are impacted strongly by the reaction force, the structural strength of the base and the holder also should be considered.

Therefore, it is important to reinforce the engagement between the base and the holder and increase the ease of detachment between the holder and the base.

SUMMARY

According to one aspect of the present disclosure, a cutting tool holding device for holding a cutting tool is provided. The cutting tool holding device includes a base, a holder, and a limiting set. The base includes a body, a storage hole and a non-circular channel. The storage hole is disposed in the body, wherein the storage hole includes an inner wall and an opening hole. The opening hole is located on the inner wall. The non-circular channel is disposed in the body and communicated with the storage hole via the opening hole, and the non-circular channel has an axis. The holder is disposed on the base and includes a disposing portion and a connecting shaft portion. The disposing portion is for the cutting tool to connect. The connecting shaft portion is connected to the disposing portion. The connecting shaft portion is for inserting into the storage hole, wherein the connecting shaft portion includes a shaft body and at least one positioning portion. The shaft body is accommodated in the storage hole. The positioning portion is concave on the shaft body and relative to the opening hole. The limiting set is disposed in the non-circular channel and includes an abutting member and a bolt. The abutting member is accommodated in the non-circular channel, and a cross-sectional shape of the abutting member is relative to a cross-sectional shape of the non-circular channel. The bolt is passed through the abutting member, wherein the abutting member is moved to the opening hole along the axis by rotating the bolt so as to push the positioning portion and abut the shaft body.

According to another aspect of the present disclosure, a cutting tool holding device for holding a cutting tool is provided. The cutting tool holding device is disposed on a milling drum of a road planer, wherein the cutting tool holding device includes a base, a holder and a limiting set. The base is disposed on a surface of the milling drum, wherein the base includes a body, a storage hole and a non-circular channel. The storage hole is disposed in the body and has a hole axis perpendicular to an axis of the milling drum, wherein the storage hole includes an inner wall and an opening hole. The opening hole is located on the inner wall. The non-circular channel is disposed in the body and communicated with the storage hole via the opening hole, wherein the non-circular channel has an axis perpendicular to the hole axis and the axis of the milling drum. The holder is disposed on the base and includes a disposing portion and a connecting shaft portion. The disposing portion is for the cutting tool to connect. The connecting shaft portion is connected to the disposing portion. The connecting shaft portion is for inserting into the storage hole, wherein the connecting shaft portion includes a shaft body and at least one positioning portion. The shaft body is accommodated in the storage hole. The positioning portion is concave on the shaft body and relative to the opening hole. The limiting set is disposed in the non-circular channel and includes an abutting member and a bolt. The abutting member is accommodated in the non-circular channel. The bolt is passed through the abutting member, wherein the abutting member is moved to the opening hole along the axis by rotating the bolt so as to push the positioning portion and abut the shaft body.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
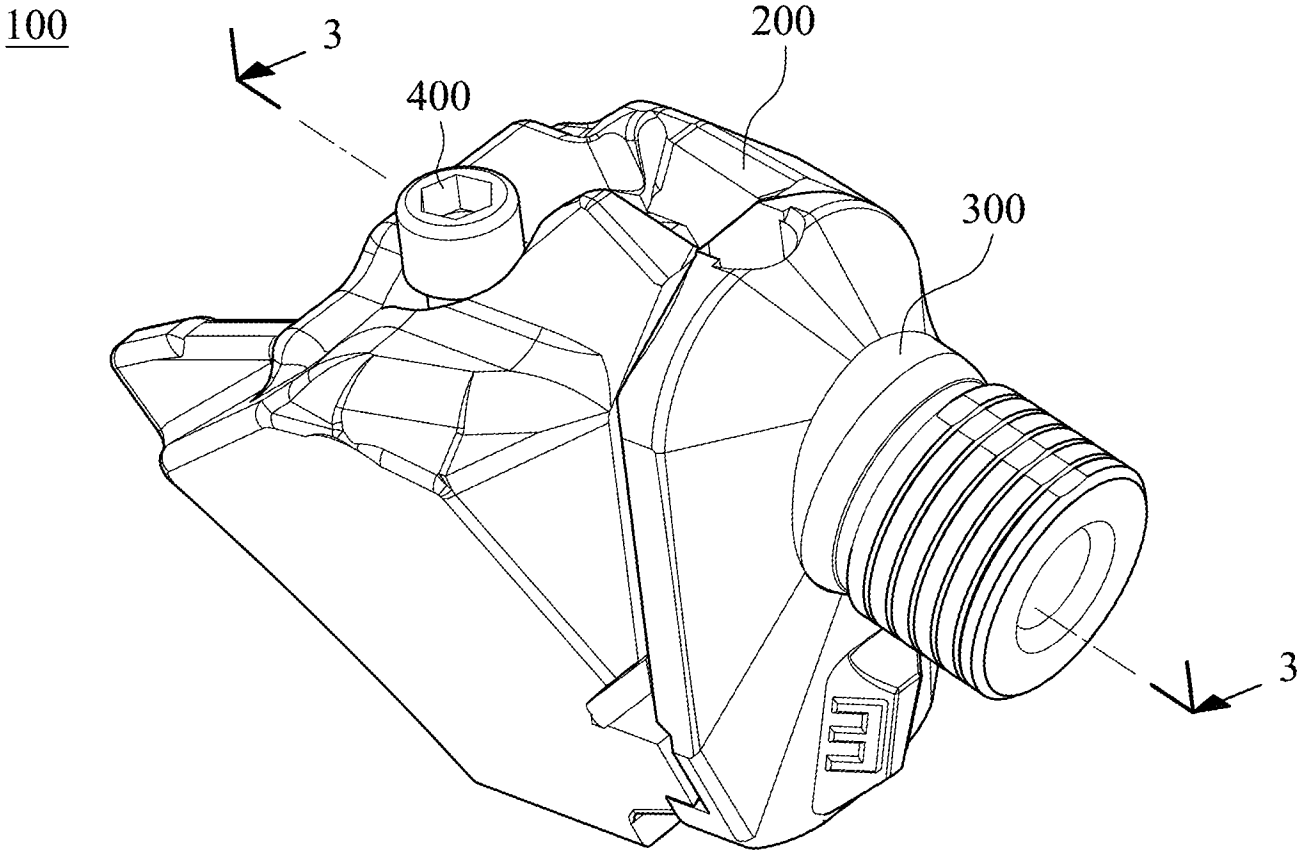
FIG. 1 is a three-dimensional schematic view of a cutting tool holding device according to one embodiment of the present disclosure.
Figure 2:
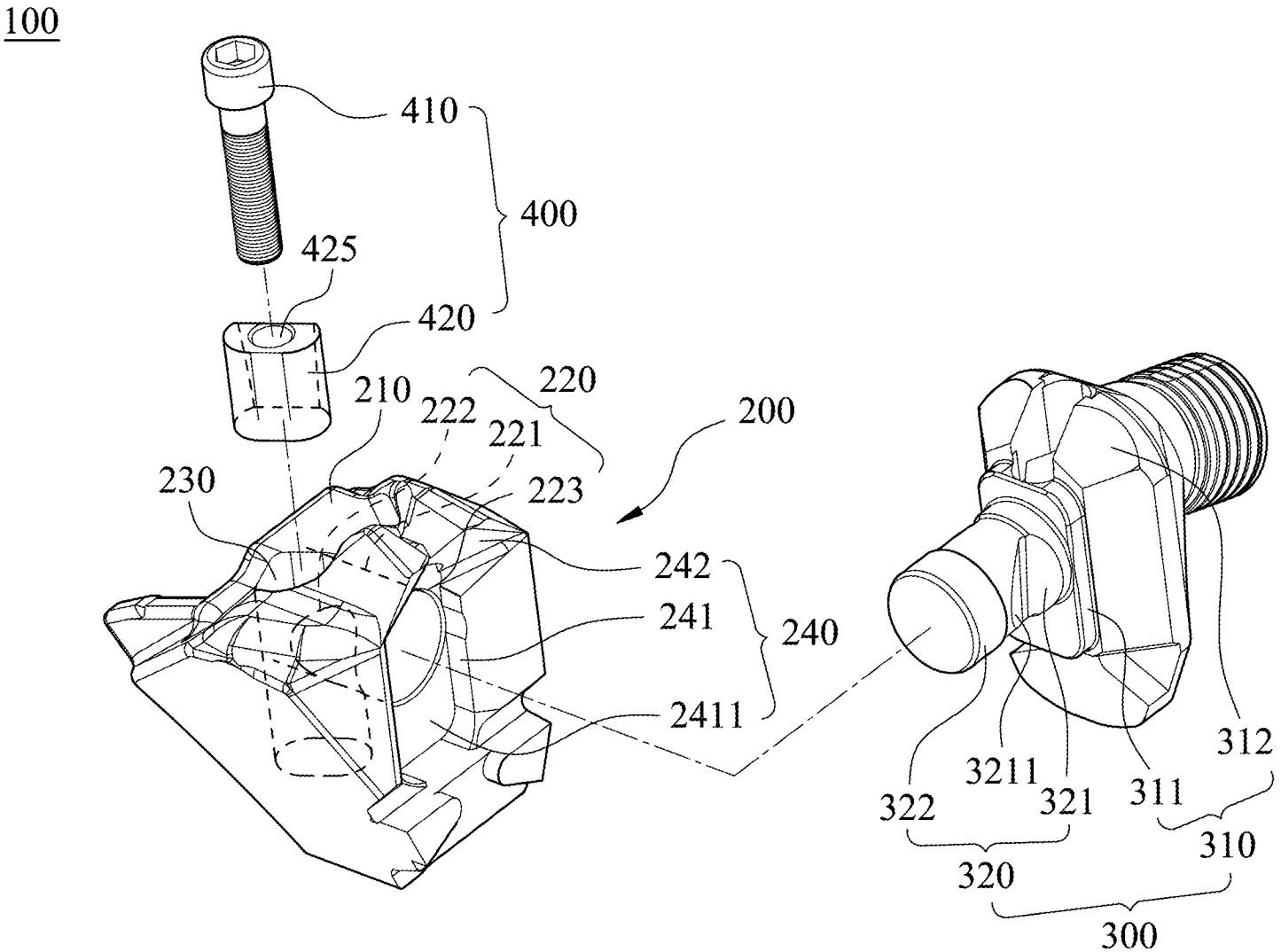
FIG. 2 is an exploded view of the cutting tool holding device as shown in FIG. 1.
Figure 3:
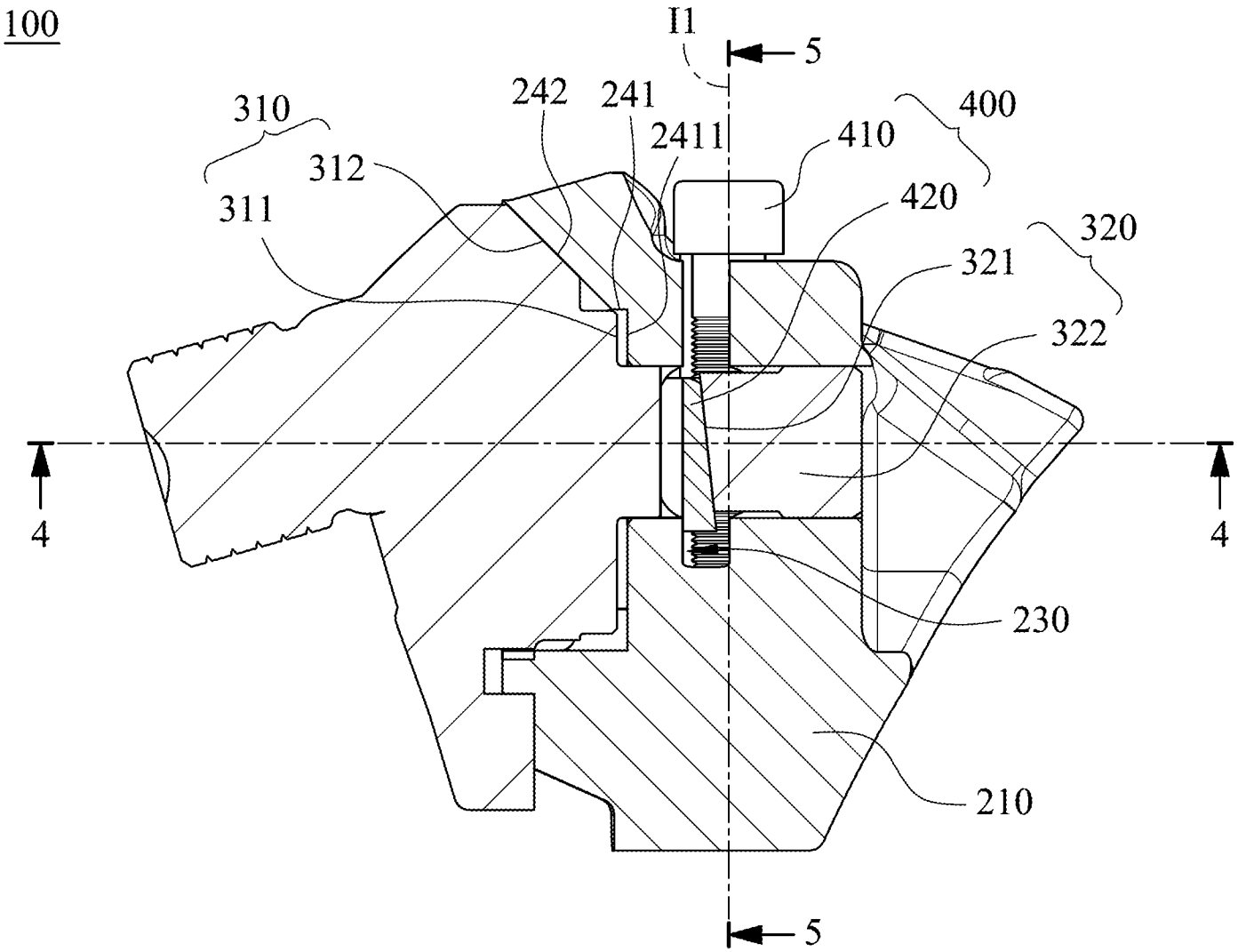
FIG. 3 is a cross-sectional view of the cutting tool holding device along line 3-3 as shown in FIG. 1.
Figure 4:
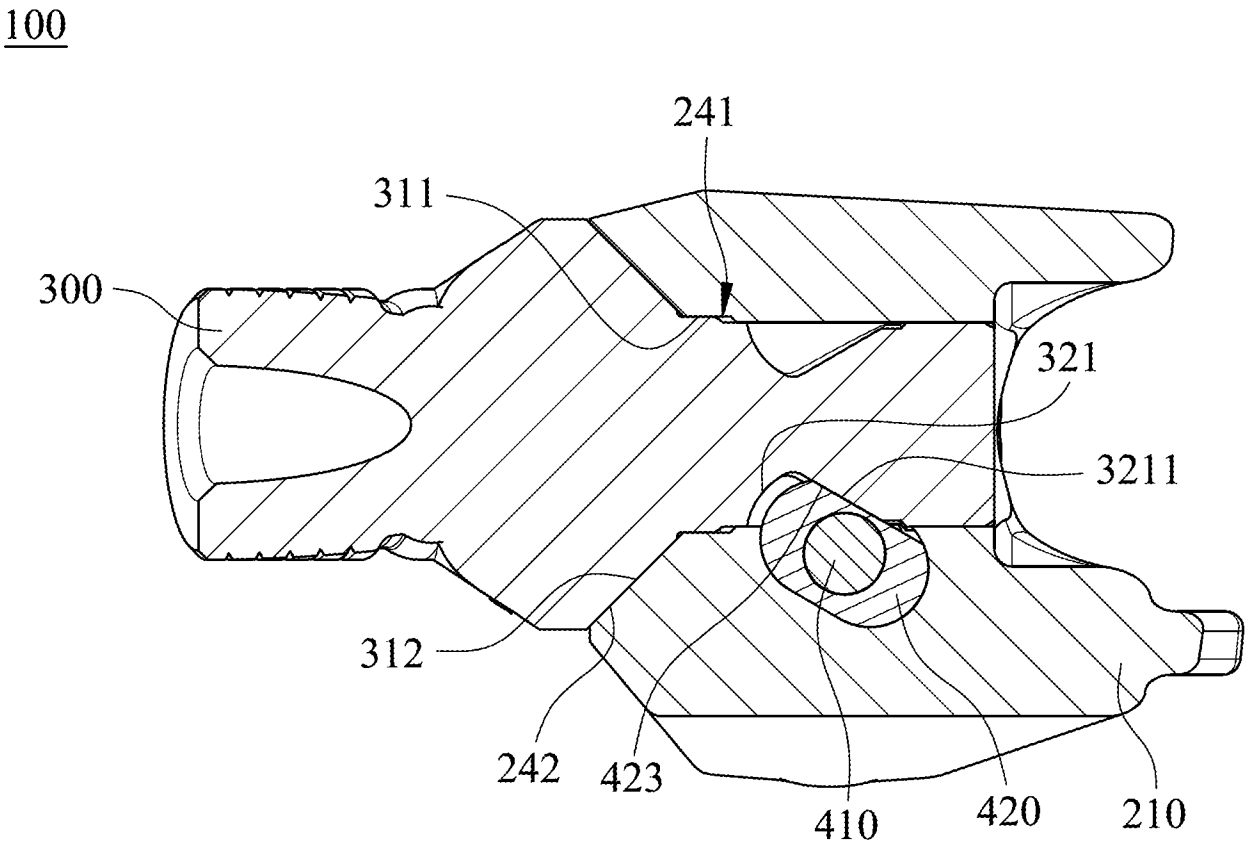
FIG. 4 is a cross-sectional view of the cutting tool holding device along line 4-4 as shown in FIG. 3.
Figure 5:
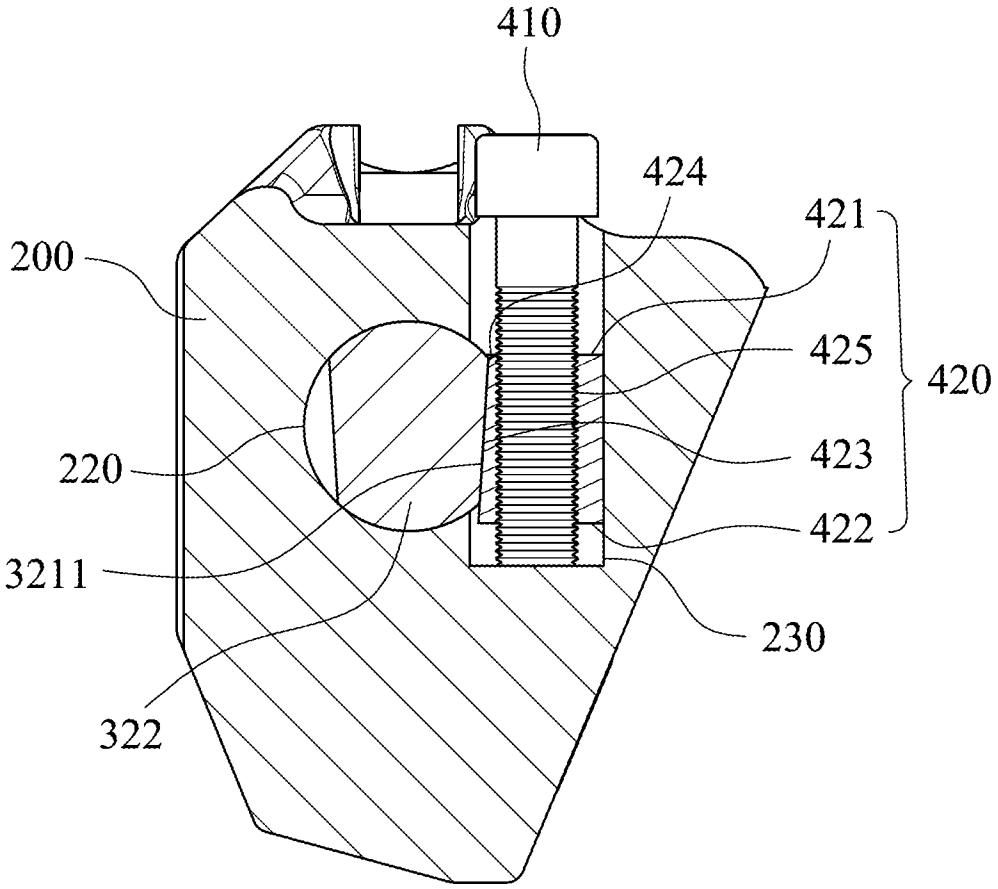
FIG. 5 is a cross-sectional view of the cutting tool holding device along line 5-5 as shown in FIG. 3.

Please refer to FIG. 1 to FIG. 5. FIG. 1 is a three-dimensional schematic view of a cutting tool holding device 100 according to one embodiment of the present disclosure. FIG. 2 is an exploded view of the cutting tool holding device 100 as shown in FIG. 1. FIG. 3 is a cross-sectional view of the cutting tool holding device 100 along line 3-3 as shown in FIG. 1. FIG. 4 is a cross-sectional view of the cutting tool holding device 100 along line 4-4 as shown in FIG. 3. FIG. 5 is a cross-sectional view of the cutting tool holding device 100 along line 5-5 as shown in FIG. 3. The cutting tool holding device 100 is for holding a cutting tool and includes a base 200, a holder 300 and a limiting set 400.

The base 200 includes a body 210, a storage hole 220 and a non-circular channel 230. The storage hole 220 is disposed in the body 210, wherein the storage hole 220 includes an inner wall 221 and an opening hole 222. The opening hole 222 is located on the inner wall 221. The non-circular channel 230 is disposed in the body 210 and communicated with the storage hole 220 via the opening hole 222, and the non-circular channel 230 has an axis I1. The holder 300 is disposed on the base 200 and includes a disposing portion 310 and a connecting shaft portion 320. The disposing portion 310 is for the cutting tool to connect. The connecting shaft portion 320 is connected to the disposing portion 310. The connecting shaft portion 320 is for inserting into the storage hole 220, wherein the connecting shaft portion 320 includes a shaft body 322 and at least one positioning portion 321. The shaft body 322 is accommodated in the storage hole 220. The positioning portion 321 is concave on the shaft 322 and relative to the opening hole 222. The limiting set 400 is disposed in the non-circular channel 230 and includes an abutting member 420 and a bolt 410. The abutting member 420 is accommodated in the non-circular channel 230, and a cross-sectional shape of the abutting member 420 is relative to a cross-sectional shape of the non-circular channel 230. The bolt 410 is passed through the abutting member 420, wherein the abutting member 420 is moved to the opening hole 222 along the axis I1 by rotating the bolt 410 so as to push the positioning portion 321 and abut the shaft body 322.

Therefore, the abutting member 420 is limited by the non-circular cross-sectional shape of the non-circular channel 230, and the abutting member 420 is moved along the axis I1 by rotating the bolt 410 so as to abut the connecting shaft portion 320. As a result, the purposes of the simple structure and easy assembling can be achieved. At the same time, the integrity of the entire cutting tool holding device 100 can be maintained by the simple structure of the base 200, and when the strength of the base 200 is increased, the reaction force can be resisted in use. The details of the structure of the cutting tool holding device 100 will be described as follows.

The storage hole 220 and the non-circular channel 230 are disposed in the body 210. The storage hole 220 and the non-circular channel 230 are staggered and communicated with each other. That is, the opening hole 222 of the inner wall 221 in the storage hole 220 can be deemed as the opening hole (not labeled) of the inner wall (not labeled) in the non-circular channel 230, so that the storage hole 220 and the non-circular channel 230 are communicated with each other.

The holder 300 is disposed on the base 200 via the connecting shaft portion 320 which is inserted into the storage hole 220. In order to assemble the holder 300 and the base 200 firmly, the disposing portion 310 of the holder 300 includes an embedding section 311, wherein the embedding section 311 is connected to the connecting shaft portion 320. The storage hole 220 includes a circular opening 223 is communicated with an external environment. The base 200 further includes a positioning concave 240. The positioning concave 240 is disposed in the body 210 and includes an embedding notch 241, wherein a shape of the embedding notch 241 is relative to the embedding section 311. The embedding notch 241 includes a bottom wall 2411, wherein the circular opening 223 is located on the bottom wall 2411. The shaft body 322 is inserted into the storage hole 220 through the circular opening 223, and the embedding section 311 is embedded in the embedding notch 241. Furthermore, the disposing portion 310 can further include a plurality of connecting surfaces 312 which are connected around the embedding section 311, and the positioning concave 240 further includes a plurality of positioning surfaces 242 which surround the embedding notch 241 and relative to the connecting surfaces 312.

More specifically, the embedding notch 241 is concave on the body 210, wherein the embedding notch 241 is a shallow trough structure as rectangular. The plurality of positioning surfaces 242 surround the embedding notch 241 so as to form the positioning concave 240 in the body 210 with the embedding notch 241. By the arrangement of the circular opening 223 located on the bottom wall 2411 of the embedding notch 241, when the shaft body 322 of the holder 300 is inserted into the storage hole 220 through the circular opening 223, the embedding section 311 of the disposing portion 310 can be accommodated in the embedding notch 241, at the same time, each of the connecting surfaces 312 and each of the positioning surfaces 242 can be abutted with each other.

In the embodiment of FIG. 2, a shape of each connecting surface 312 is relative to a shape of each positioning surface 242. The plurality of connecting surfaces 312 are connected around the embedding section 311, and the plurality of positioning surfaces 242 are connected around the embedding notch 241. Therefore, when each connecting surface 312 is relative to each positioning surface 242, the central aligning function can be provided so as to avoid the eccentric between the shaft body 322 and the storage hole 220, thus sufficient supporting force can be provided for increasing the stability of the cutting tools in using.

The abutting member 420 includes a screw hole 425. The screw hole 425 is coupled with a screw thread of the bolt 410. The abutting member 420 is limited by the non-circular shape of the non-circular channel 230 such that the abutting member 420 cannot be rotated in the non-circular channel 230. Therefore, the abutting member 420 can be moved along the axis I1 but not rotated by rotating the bolt 410. When the connecting shaft portion 320 of the holder 300 is inserting into the storage hole 220, the positioning portion 321 is relative to the opening hole 222, and the abutting member 420 is moved to the opening hole 222 by rotating the bolt 410, so that the abutting member 420 can be inserted into the positioning portion 321, and the connecting shaft portion 320 cannot be pulled out from the storage hole 220.

The cross-sectional shape of the non-circular channel 230 can be ellipse, and the abutting member 420 is cylindroid. When the abutting member 420 is cylindroid, the smoothness of moving along the axis I1 can be increased, and at the same time, the stress concentration at any single position can be avoided so as to increase the service life. In other embodiments, the cross-sectional shape of the non-circular channel 230 can be any non-circular shape, such as triangular, square, rectangular or polygonal, and will not be limited thereto.

In the embodiment of FIG. 2, the abutting member 420 can further include a first end surface 421, a second end surface 422, a stepping portion 424 and an inclined plane 423. The second end surface 422 is relative to the first end surface 421. The stepping portion 424 is connected to the first end surface 421. The inclined plane 423 is connected between the stepping portion 424 and the second end surface 422. The positioning portion 321 is concave on the shaft body 322. The positioning portion 321 can include an abutting surface 3211. The abutting surface 3211 is inclined from a side of the shaft body 322 to the other side of the shaft body 322, and the abutting surface 3211 is abutted by the inclined plane 423. That is, a slope and a tilt direction of the abutting surface 3211 are in accordance with a slope and a tilt direction of the inclined plane 423 on the abutting member 420, so that the abutting member 420 can be abutted the positioning portion 321 by moving upward along the axis I1.

Figure 6:
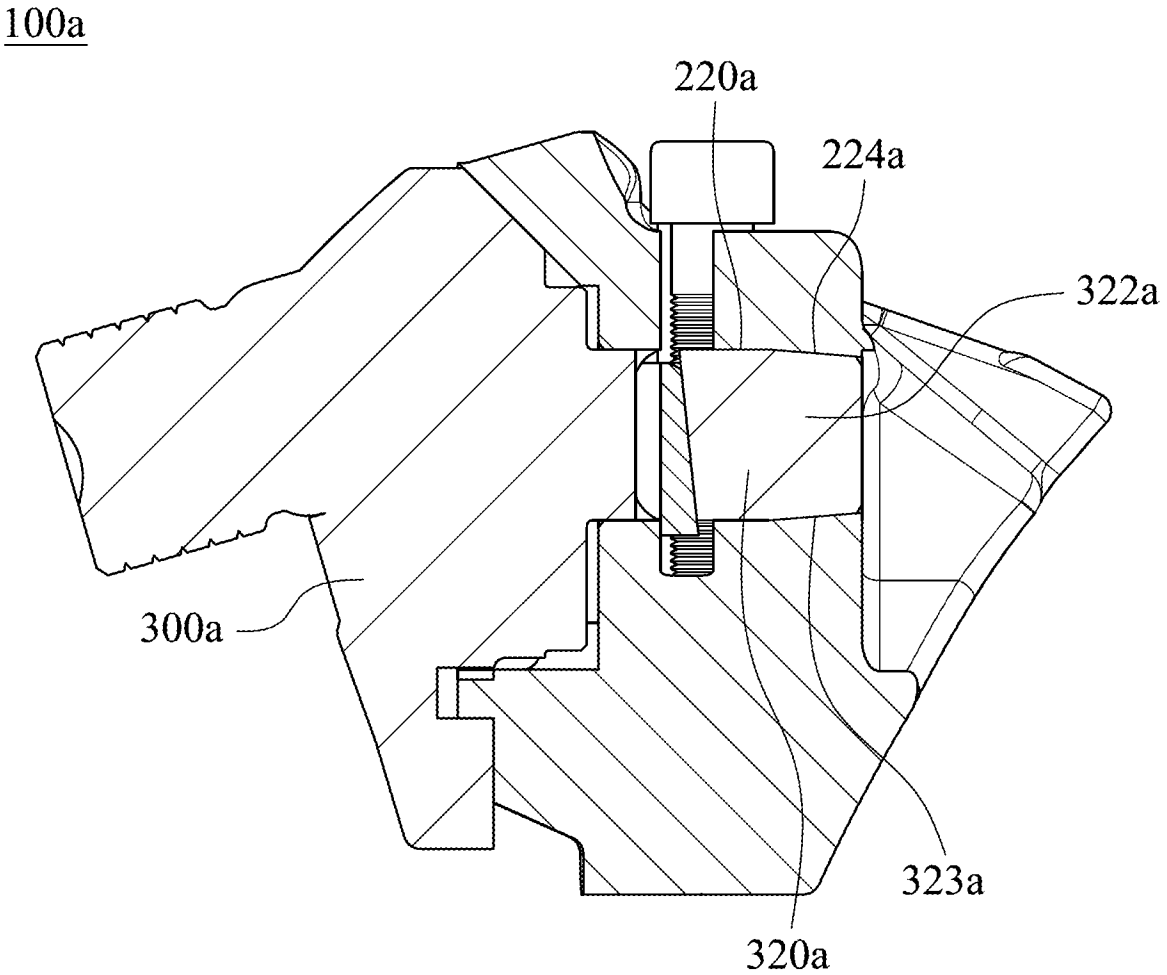
FIG. 6 is a cross-sectional view of the cutting tool holding device according to another embodiment of the present disclosure.

Please refer to FIG. 6. FIG. 6 is a cross-sectional view of the cutting tool holding device 100*a* according to another embodiment of the present disclosure. The cutting tool holding device 100*a* is similar to the cutting tool holding device 100 of FIG. 1 to FIG. 5, and according to the embodiment of FIG. 6, the storage hole 220*a* includes an inward section 224*a*. The connecting shaft portion 320*a* of the holder 300*a* includes a cone section 323*a* relative to the inward section 224*a*. As shown in FIG. 6, the storage hole 220*a* gradually narrows toward the end to form the inward section 224*a*. A wall thickness of the shaft body 322*a* on the connecting shaft portion 320*a* also gradually narrows toward the end to form the cone section 323*a*. By the arrangement of the inward section 224*a* and the cone section 323*a*, the connecting shaft portion 320*a* of the holder 300*a* can be inserted into the storage hole 220*a* more easily, and the cooperation between the cone section 323*a* and the inward section 224*a* can provide the effect of central alignment.

Figure 7:
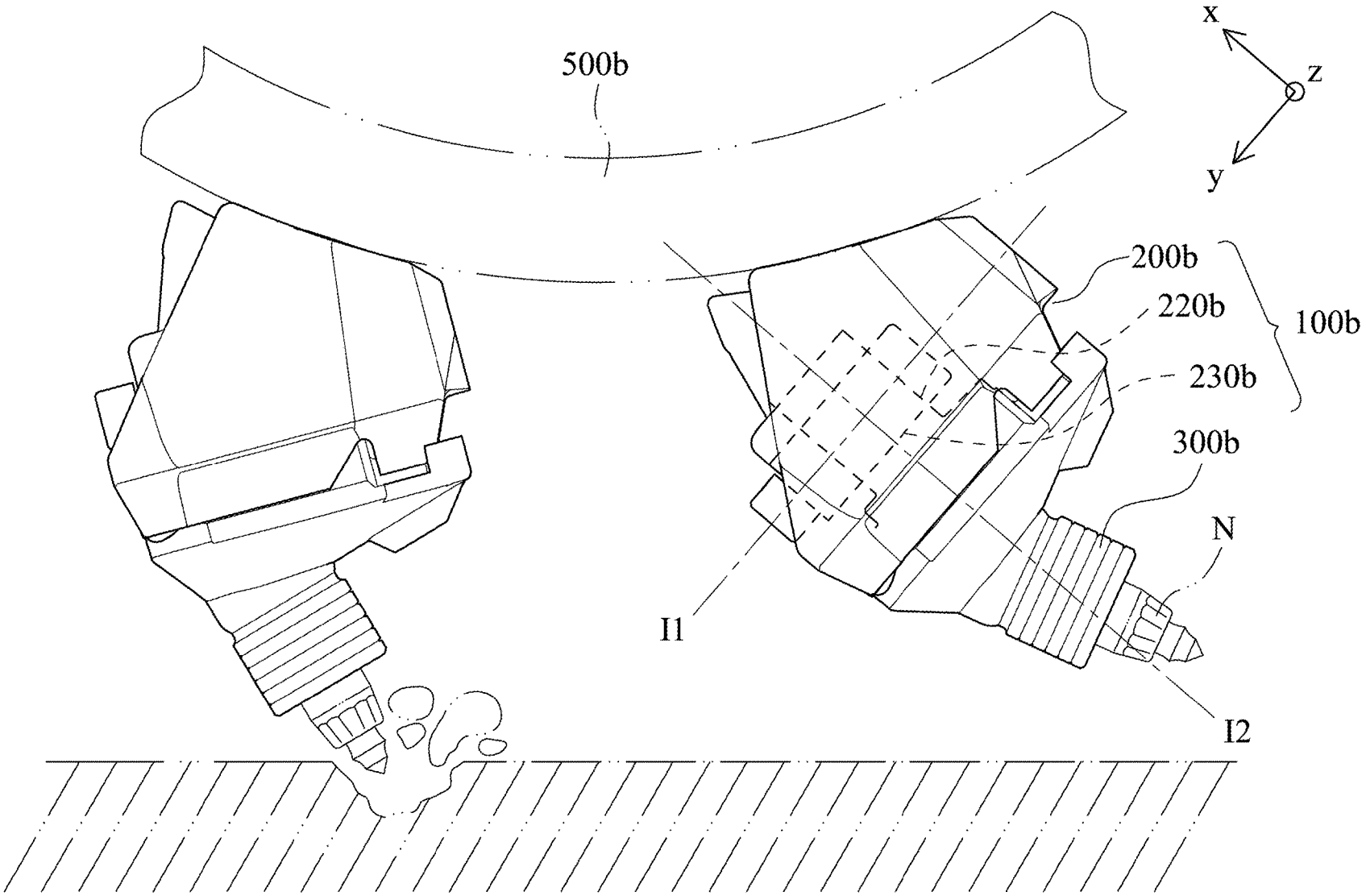
FIG. 7 is a cross-sectional view of the cutting tool holding device according to further another embodiment of the present disclosure.

Please refer to FIG. 7, wherein FIG. 7 is a cross-sectional view of the cutting tool holding device 100*b* according to further another embodiment of the present disclosure. The cutting tool holding device 100*b* is disposed on a milling drum 500*b* of a road planer. The cutting tool holding device 100*b* is similar to the cutting tool holding device 100 of FIG. 1 to FIG. 5, wherein the storage hole 220*b* of the base 200*b* has a hole axis I2 (x-axial direction) perpendicular to an axis of the milling drum (vertical paper, z-axial direction). The non-circular channel 230*b* has an axis I1 (y-axial direction) perpendicular to the hole axis I2 and the axis of the milling drum. Therefore, when the cutting tool N of the cutting tool holding device 100*b* is replaced, the limiting set can be operated directly to release the holder 300*b* without the interference from other cutting tool holding devices, and increasing the workability.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A cutting tool holding device, which is for holding a cutting tool, the cutting tool holding device comprising:
- a base comprising:
  - a body;
  - a storage hole disposed in the body, the storage hole comprising:
    - an inner wall; and
    - an opening hole located on the inner wall; and
  - a non-circular channel disposed in the body and communicated with the storage hole via the opening hole, the non-circular channel having an axis;
- a holder disposed on the base, and comprising:
  - a disposing portion for the cutting tool to connect; and
  - a connecting shaft portion connected to the disposing portion, the connecting shaft portion for inserting into the storage hole, and the connecting shaft portion comprising:
    - a shaft body accommodated in the storage hole; and
    - at least one positioning portion being concave on the shaft body and corresponding to the opening hole; and
- a limiting set disposed in the non-circular channel, and comprising:
  - an abutting member accommodated in the non-circular channel and a cross-sectional shape of the abutting member corresponding to a cross-sectional shape of the non-circular channel, wherein the cross-sectional shape of the non-circular channel is ellipse, the abutting member is cylindroid, and the abutting member comprises:
    - a first end surface;
    - a second end surface opposite to the first end surface;
    - a stepping portion connected to the first end surface; and
    - an inclined plane connected between the stepping portion and the second end surface; and
  - a bolt passed through the abutting member;
- wherein the abutting member is moved to the opening hole along the axis by rotating the bolt so as to push the positioning portion and abut the shaft body, and the positioning portion comprises an abutting surface, the abutting surface is inclined from a side of the shaft body to the other side of the shaft body, and the abutting surface is abutted by the inclined plane.

2. The cutting tool holding device of claim 1, wherein the disposing portion comprises an embedding section connected to the shaft body, and the storage hole comprises a circular opening communicated with an external environment, and the base further comprises:
- a positioning concave disposed in the body of the base, and comprising:
  - an embedding notch, wherein a shape of the embedding notch is corresponding to the embedding section, and the embedding notch comprises a bottom wall;
- wherein the circular opening is located on the bottom wall, when the shaft body is inserted into the storage hole through the circular opening, the embedding section is embedded in the embedding notch.

3. The cutting tool holding device of claim 2, wherein the disposing portion further comprises a plurality of connecting surfaces connected around the embedding section, and the positioning concave further comprises:
- a plurality of positioning surfaces surround the embedding notch and corresponding to the connecting surfaces.

4. A cutting tool holding device, which is for holding a cutting tool, the cutting tool holding device disposed on a milling drum of a road planer, the cutting tool holding device comprising:
- a base disposed on a surface of the milling drum, the base comprising:

a body;

a storage hole disposed in the body and having a hole axis perpendicular to an axis of the milling drum, the storage hole comprising:

an inner wall; and an opening hole located on the inner wall; and a non-circular channel disposed in the body and communicated with the storage hole via the opening hole, the non-circular channel having an axis perpendicular to the hole axis and the axis of the milling drum;

a holder disposed on the base, and comprising:

a disposing portion for the cutting tool to connect; and a connecting shaft portion connected to the disposing portion, the connecting shaft portion for inserting into the storage hole, and the connecting shaft portion comprising:

a shaft body accommodated in the storage hole; and at least one positioning portion being concave on the shaft body and corresponding to the opening hole; and a limiting set disposed in the non-circular channel, and comprising:

an abutting member accommodated in the non-circular channel, wherein a cross-sectional shape of the non-circular channel is ellipse, the abutting member is cylindroid, and the abutting member comprises:

a first end surface;

a second end surface opposite to the first end surface;

a stepping portion connected to the first end surface; and an inclined plane connected between the stepping portion and the second end surface; and a bolt passed through the abutting member;

wherein the abutting member is moved to the opening hole along the axis by rotating the bolt so as to push the positioning portion and abut the shaft body, and the positioning portion comprises an abutting surface, the abutting surface is inclined from a side of the shaft body to the other side of the shaft body, and the abutting surface is abutted by the inclined plane.

5. The cutting tool holding device of claim 4, wherein the storage hole comprises an inward section, and the connecting shaft portion comprises a cone section corresponding to the inward section.

6. The cutting tool holding device of claim 4, wherein the disposing portion comprises an embedding section connected to the shaft body, and the storage hole comprises a circular opening communicated with an external environment, and the base further comprises:

a positioning concave disposed in the body of the base, and comprising:

an embedding notch, wherein a shape of the embedding notch is corresponding to the embedding section, and the embedding notch comprises a bottom wall;

wherein the circular opening is located on the bottom wall, when the shaft body is inserted into the storage hole through the circular opening, the embedding section is embedded in the embedding notch.

* * * * *